US009123218B2

(12) United States Patent
Tsubokawa et al.

(10) Patent No.: US 9,123,218 B2
(45) Date of Patent: Sep. 1, 2015

(54) FIRE CONTROL PANEL WITH A DISPLAY UNIT FOR DISPLAYING SYSTEM INFORMATION

(71) Applicant: NOHMI BOSAI LTD., Chiyoda-ku, Tokyo (JP)

(72) Inventors: Katsuhide Tsubokawa, Tokyo (JP); Masahiro Hagita, Tokyo (JP)

(73) Assignee: NOHMI BOSAI, LTD., Tokyo (JP)

( * ) Notice: Subject to any disclaimer, the term of this patent is extended or adjusted under 35 U.S.C. 154(b) by 181 days.

(21) Appl. No.: 13/935,871

(22) Filed: Jul. 5, 2013

(65) Prior Publication Data

US 2014/0009279 A1 Jan. 9, 2014

(30) Foreign Application Priority Data

Jul. 5, 2012 (JP) ..... 2012-151919

(51) Int. Cl.
*G08B 21/00* (2006.01)
*G08B 17/00* (2006.01)
*G08B 25/14* (2006.01)

(52) U.S. Cl.
CPC ..... *G08B 17/00* (2013.01); *G08B 25/14* (2013.01)

(58) Field of Classification Search
CPC ..... G08B 17/00
USPC ..... 340/286.05, 506, 517, 518, 519, 525, 340/533, 539.16, 539.27
See application file for complete search history.

(56) References Cited

U.S. PATENT DOCUMENTS 5,271,045 A * 12/1993 Scarola et al. ..... 376/216
2007/0115112 A1* 5/2007 Elwell et al. ..... 340/538

FOREIGN PATENT DOCUMENTS

JP 11-283149 10/1999

OTHER PUBLICATIONS

Office Communication dated Jun. 3, 2015 in corresponding Chinese patent application No. 201310272055.3.

* cited by examiner

*Primary Examiner* — Jeffery Hofsass
(74) *Attorney, Agent, or Firm* — Wenderoth, Lind & Ponack, L.L.P.

(57) ABSTRACT

A fire control panel in which an address map window (30), in which terminal device control switches (31) each indicating an address number (AD) of a terminal device are arranged in a matrix shape, is displayed on a display/operation unit (2). In addition, each of the terminal device control switches (31) corresponding to a status stored in a terminal database (DB) is displayed in a display mode that differs depending on each status. Accordingly, it is possible to grasp status information on a large number of terminal devices at a glance through one screen.

3 Claims, 5 Drawing Sheets

| CIR CUIT | ADDRESS NUMBER | TYPE OF TERMINAL DEVICE | SERIAL NUM BER | TYPE OF CONTROLLED DEVICE | STATUS |
|---|---|---|---|---|---|
| 1 | AD 1 | ANALOG PHOTOELECTRIC DETECTOR | – | – | NORMAL |
| 1 | AD 2 | ANALOG HEAT DETECTOR | – | – | NORMAL |
| 1 | AD 3 | ADDRESSABLE MANUAL CALL POINT | – | – | INTER-RUPTED |
| 1 | AD 3 0 | OUTPUT MODULE FOR LOCAL BELL | 1 | LOCAL BELL | NORMAL |
| | | | 2 | LOCAL BELL | NORMAL |
| | | | 3 | LOCAL BELL | NORMAL |
| | | | 4 | LOCAL BELL | NORMAL |
| 1 | AD 4 0 | INPUT MODULE FOR INPUT | – | – | INPUT |
| 1 | AD 5 0 | SMOKE CONTROL OUTPUT MODULE | 1 | FIRE DOOR | NORMAL |
| | | | 2 | SMOKE EXHAUST FAN | ABNORMAL |
| | | | 3 | SHUTTER | NORMAL |
| | | | 4 | HANGING WALL | NORMAL |

| CIR CUIT | ADDRESS NUMBER | TYPE OF TERMINAL DEVICE | SERIAL NUM BER | TYPE OF CONTROLLED DEVICE | STATUS |
|---|---|---|---|---|---|
| 1 | AD 1 | ANALOG PHOTOELECTRIC DETECTOR | – | – | NORMAL |
| 1 | AD 2 | ANALOG HEAT DETECTOR | – | – | NORMAL |
| 1 | AD 3 | ADDRESSABLE MANUAL CALL POINT | – | – | INTER-RUPTED |
| 1 | AD 3 0 | OUTPUT MODULE FOR LOCAL BELL | 1 | LOCAL BELL | NORMAL |
| | | | 2 | LOCAL BELL | NORMAL |
| | | | 3 | LOCAL BELL | NORMAL |
| | | | 4 | LOCAL BELL | NORMAL |
| 1 | AD 4 0 | INPUT MODULE FOR INPUT | – | – | INPUT |
| 1 | AD 5 0 | SMOKE CONTROL OUTPUT MODULE | 1 | FIRE DOOR | NORMAL |
| | | | 2 | SMOKE EXHAUST FAN | ABNORMAL |
| | | | 3 | SHUTTER | NORMAL |
| | | | 4 | HANGING WALL | NORMAL |

Fig. 3

FIRE CONTROL PANEL WITH A DISPLAY UNIT FOR DISPLAYING SYSTEM INFORMATION

BACKGROUND OF THE INVENTION

1. Field of the Invention

The present invention relates to a fire control panel connected to a plurality of terminal devices.

2. Description of the Related Art

Up to now, in a fire control panel for collecting status information on terminal devices through communications, the status information on the terminal device such as an operation thereof or a failure thereof is displayed as character information on a liquid crystal screen or the like. Further, when there are a large number of pieces of event information, a switch on a display screen is operated by an operator to change over the display, to thereby display the status information on the terminal device that is not displayed (see, for example, Japanese Patent Application Laid-open No. Hei 11-283149).

However, a large number of terminal devices are occasionally not installed during construction or renovation of a building or in other such occasion, with the result that it may be determined that a large number of failures have occurred on grounds that the terminal devices are not connected to a signal line. In a state in which the terminal devices are not installed, a large number of errors are output, which leads to a problem in that the status information on the terminal devices are difficult to confirm.

SUMMARY OF THE INVENTION

The present invention has been made in order to solve the above-mentioned problem, and an object thereof is to provide a fire control panel that allows the statuses of a plurality of terminal devices to be confirmed with high efficiency.

According to one embodiment of the present invention, there is provided a fire control panel, which is connected to a plurality of terminal devices via a signal line, including: a storage unit for storing a terminal database in which addresses assigned to the plurality of terminal devices on a one-to-one basis and statuses of the plurality of terminal devices are stored in association with each other; a display unit for displaying information relating to the plurality of terminal devices stored in the terminal database; and a display control unit for displaying a plurality of terminal device control symbols respectively labeled with the addresses of the plurality of terminal devices on the display unit in a state of being arranged in a matrix shape, and further displaying the plurality of terminal device control symbols on the display unit in different display modes corresponding to the statuses of the plurality of terminal devices stored in the terminal database.

According to the fire control panel constructed in accordance with one embodiment of the present invention, the addresses of the terminal devices are displayed in a list, while status information is displayed in a mode corresponding to each status, to thereby allow statuses of a large number of terminal devices to be grasped at a glance through one screen, and hence it is possible to improve working efficiency.

BRIEF DESCRIPTION OF THE DRAWINGS

In the accompanying drawings:

FIG. 3 is a table showing an example of a data structure of a terminal database stored in a storage unit illustrated in FIG. 1;

DETAILED DESCRIPTION OF THE PREFERRED EMBODIMENT

Figure 1:
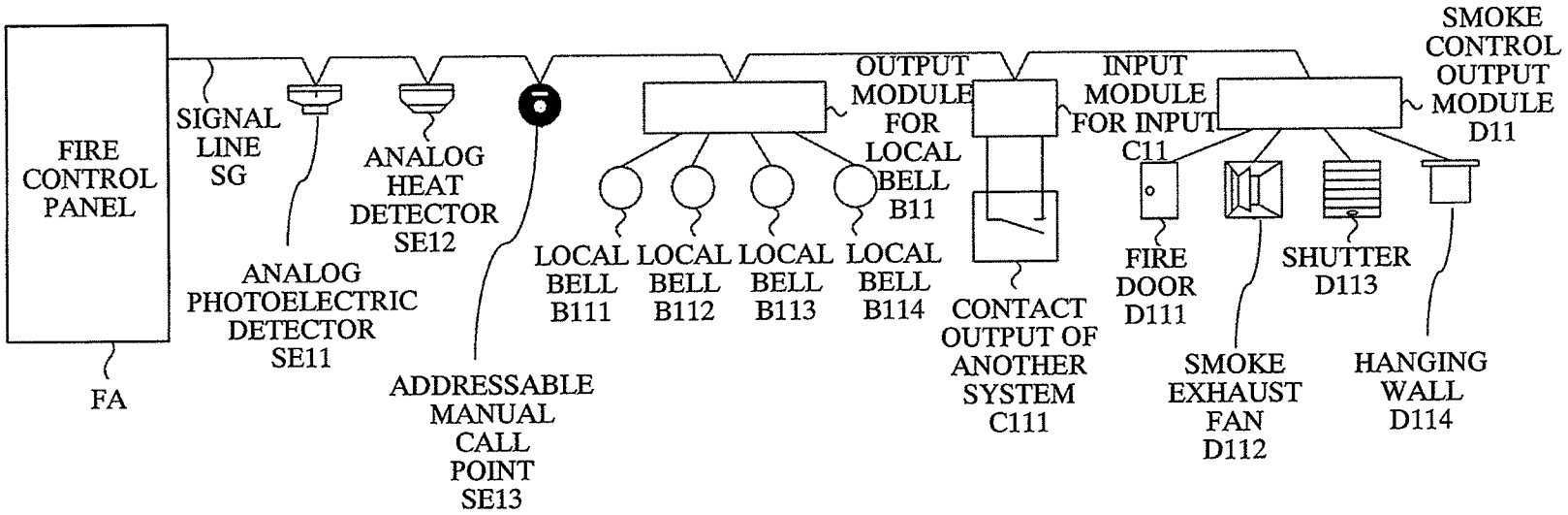
FIG. 1 is a system configuration diagram illustrating a fire control panel according to a preferred embodiment of the present invention.

FIG. 1 is a system configuration diagram illustrating a fire control panel according to a preferred embodiment of the present invention. A fire control panel FA is connected to a plurality of terminal devices such as a fire detector via a signal line SG. The fire control panel FA and each of the terminal devices communicate to/from each other by, for example, a pulse signal obtained by combining a high-level voltage (V1H) and a low-level voltage (V1L). Further, a unique address number AD is assigned to each of the terminal devices, and the fire control panel can identify each of the terminal devices based on this address number AD.

Examples of the terminal device to be connected to the fire control panel FA include an analog photoelectric detector SE11, an analog heat detector SE12, and an addressable manual call point SE13. The analog photoelectric detector SE11 is one kind of smoke detector, and transmits an analog value corresponding to detected smoke to the fire control panel FA. The analog heat detector SE12 is one kind of heat detector, and transmits an analog value corresponding to a detected ambient temperature to the fire control panel FA. The addressable manual call point SE13 is a so-called fire manual call point, including a push button to be manually operated by a person who discovers a fire. When the push button is turned on, a fire signal is transmitted to the fire control panel FA.

Further, controlled devices are connected to the signal line SG via various output modules being the terminal devices. In FIG. 1, for example, an output module B11 for a local bell is connected to the signal line SG, and four local bells B111 to B114 are connected to the output module B11 for the local bell. In addition, each of the local bells B111 to B114 outputs sound for issuing an alarm about a fire based on a control signal received from the fire control panel FA. Further, an input module C11 for an input is connected to the signal line SG, and a contact output (switch) C111 included in another system that operates when a serious problem such as a failure of the other system occurs is connected to the input module C11 for the input. Further, a smoke control output module D11 is connected to the signal line SG, and a fire door D111, a smoke exhaust fan D112, a shutter D113, and a hanging wall D114, which serve as smoke control devices, are connected to the smoke control output module D11. Those terminal devices connected to the signal line SG are communicated to/from the fire control panel FA via the signal line SG, and are supplied with power via the signal line SG.

The fire control panel FA collects status information on the terminal devices from the respective terminal devices by the following three methods, in other words, point polling, selecting, and system polling, or controls the terminal devices and the like.

(1-1) Point Polling

In order to collect statuses of the plurality of connected terminal devices, the fire control panel FA transmits a status information request command to the terminal devices in groups of several. On the other hand, each of the terminal devices notifies the fire control panel FA of the status information in response to the status information request command at an appropriate timing corresponding to its own address number AD. The fire control panel FA repeatedly communicates to/from the groups in this manner, to thereby collect the status information on all the terminal devices.

(1-2) Selecting

After designating the address number AD corresponding to a desired terminal device, the fire control panel FA transmits a predetermined control command thereto, to thereby control the desired terminal device, or transmits a request command for the status information or the like to a desired terminal device, to thereby collect the status information from each terminal device. The terminal device whose address number AD has been designated notifies the fire control panel FA of a control result in response to the control command, or notifies the fire control panel FA of the requested status information.

(1-3) System Polling

The fire control panel FA transmits a common control command to all the terminal devices, to thereby control the respective terminal devices. Examples of the control command issued in the system polling include a fire reset command (command to reset a detector, a module, or the like that has output the fire signal to a normal supervisory state) and a local sound stop command (command to inactivate the output module B11 for the local bell that is sounding).

(2) Regarding Collection of Information on Status in which Abnormality has Occurred If fire information is included in the status information collected from the terminal devices such as the analog photoelectric detector SE11 in the point polling, the fire control panel FA transmits the control signal in the selecting to the smoke control output module D11 corresponding to the terminal device that has transmitted the fire information based on a database stored in a storage unit 3, to thereby activate a controlled device connected to the output module. Further, when the status information request command is transmitted in the point polling to the terminal device registered in a terminal database DB stored in the storage unit 3 of the fire control panel FA, if there exists a terminal device that does not respond to the status information request command, a display/operation unit 2 displays that there is no response as described later.

Figure 2:
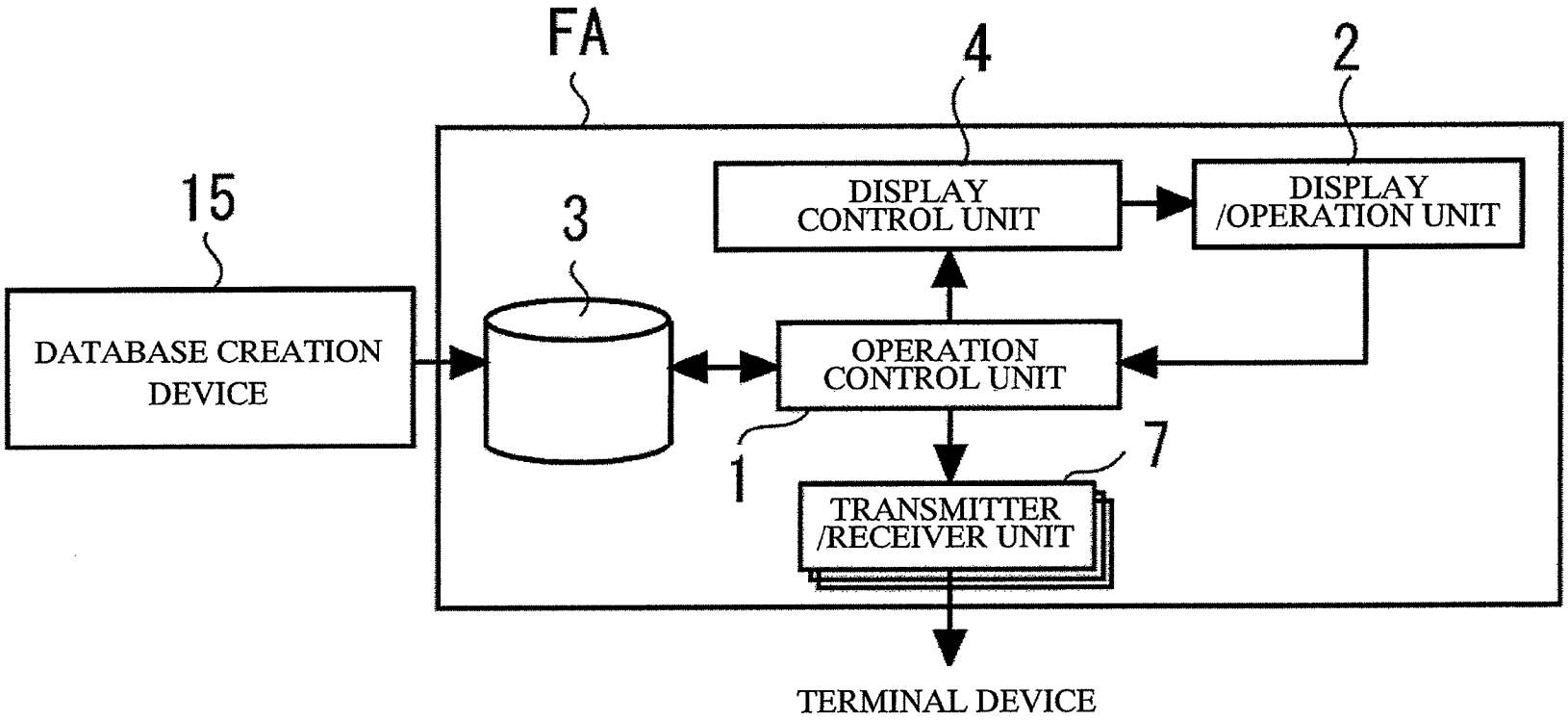
FIG. 2 is a functional block diagram illustrating an example of the fire control panel illustrated in FIG. 1.

FIG. 2 is a functional block diagram illustrating an example of the fire control panel FA illustrated in FIG. 1. The fire control panel FA includes the display/operation unit 2, the storage unit 3, and a display control unit 4. An operation control unit 1 controls an operation of the fire control panel FA, and performs each of the above-mentioned kinds of polling on the respective terminal devices via a transmitter/receiver unit 7, to collect the statuses of the respective terminal devices and cause the respective terminal devices to perform various operations such as an examination. The operation control unit 1 stores the statuses of the respective terminal devices collected by each kind of polling in the storage unit 3.

The display/operation unit 2 is formed of, for example, a touch panel, and has a function as a display unit for displaying various kinds of information, while having a function as an operation unit that allows an operator to touch a screen to select a predetermined switch (command button). Therefore, a predetermined screen is displayed on the display/operation unit 2, while a predetermined selection signal is output to the operation control unit 1 when the operator touches the touch panel. The displaying of the display/operation unit 2 is controlled by the display control unit 4.

The terminal database DB that stores various kinds of data related to the terminal devices is stored in the storage unit 3. FIG. 3 is a table showing an example of a data structure of the terminal database DB stored in the storage unit 3. Note that, the terminal database DB allows the data to be registered/updated by an external database creation device 15. In the terminal database DB shown in FIG. 3, the address number AD of each of the terminal devices connected to the fire control panel FA and a terminal device type KI thereof are stored in association with each other.

In more detail, a "circuit", an "address number AD", the "terminal device type KI", a "serial number", a "type of controlled device", and a "status" are stored in the terminal database DB. The "circuit" indicates which one of the plurality of transmitter/receiver units 7 the terminal device is connected to. The "address number AD" is such a number assigned to each of the terminal devices as to allow identification thereof when the fire control panel FA communicates from the transmitter/receiver unit 7 to each of the terminal devices via the signal line SG. The "terminal device type KI" means the type of each of the terminal devices that can directly communicate to/from the fire control panel FA via the signal line SG. Note that, in FIG. 3, the terminal device type KI is exemplified by a case of being stored by a real name, but a type code corresponding to each type may be assigned to perform classification/management by type code.

The "serial number" is a number assigned to (each control line connected to) a smoke control device in order to identify which of a plurality of controlled devices connected to one module is to be controlled. For example, serial numbers of 1 to 4 are assigned to the fire door D111, the smoke exhaust fan D112, the shutter D113, and the hanging wall D114, respectively, which are connected to the smoke control output module D11. The "type of controlled device" corresponds to a type condition for identifying types of the plurality of controlled devices, and means types such as the fire door, smoke exhaust fan, shutter, and hanging wall. The "status" is information indicating statuses of the terminal devices collected by the operation control unit 1, and indicates, for example, "normal", "abnormal", "warning", and "interrupted". Note that, the "status" is updated as needed, in other words, each time the polling is performed by the operation control unit 1.

Figure 4:
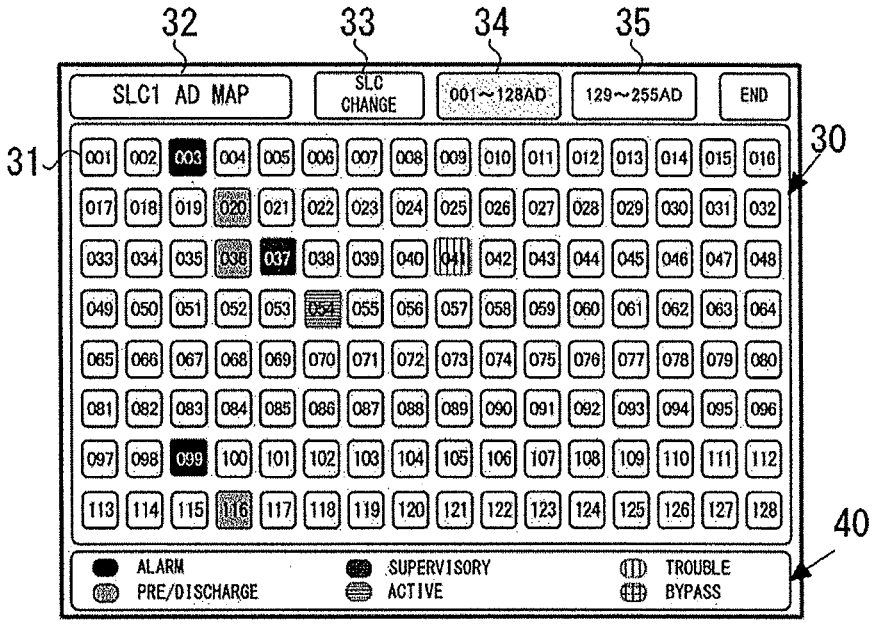
FIG. 4 is a schematic diagram illustrating an example of an address map window displayed in a display/operation unit illustrated in FIG. 1.

The display control unit 4 illustrated in FIG. 2 has a function of displaying an address map window 30 on the display/operation unit 2. FIG. 4 is a schematic diagram illustrating an example of the address map window 30 displayed in the display/operation unit 2. In FIG. 4, a plurality of terminal device control switches 31, each of which is labeled with the address number AD, are arranged in the address map window 30 in a matrix shape.

Each of the terminal device control switches 31 is displayed in a display mode (color-coding) that differs depending on the status of each of the terminal devices stored in the terminal database DB.

For example, the terminal device control switch 31 is colored in red (Alarm) in the case of a fire, pink (Pre-Discharge, Discharge) in a case where a fire extinguishing system (not shown) serving as the smoke control device has been activated or is being controlled, orange (Supervisory) in a case where a failure or the like in another system has been input, blue (Active) in a case where a local bell or the smoke control device (other than fire extinguishing system) has been activated or is being controlled, yellow (Trouble) in a case of being abnormal, or green (Bypass) in a case of being interrupted or uncontrollable. The statuses are thus displayed by coloring the terminal device control switches 31 displayed in a list, to thereby allow an operator to grasp statuses of a plurality of terminal devices at a glance, and hence it is possible to improve working efficiency.

Note that, on the address map window 30, terminal device control switches are arranged in a matrix shape so that all or half of the terminal devices connected to a signal line of one circuit can be displayed in a list on one screen.

Further, a sub-window 40 is placed in a lower part of the address map window 30. In an initial state in which none of the terminal device control switches 31 is selected, as illustrated in FIG. 4, guidance information indicating a meaning of a mode (color) for each status is displayed in the sub-window 40. When any one of the plurality of terminal device control switches 31 arranged in the address map window 30 is selected, the detailed status of the terminal device is displayed in the sub-window 40.

Figure 5:
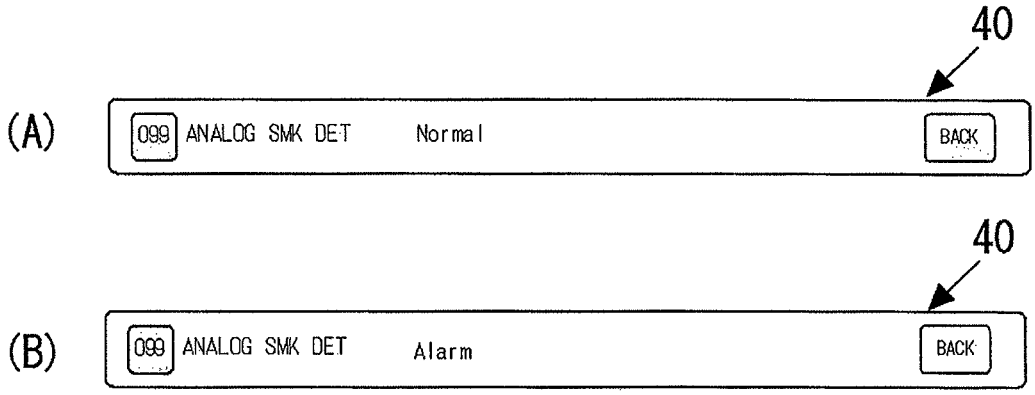
FIGS. 5A and 5B are schematic diagrams illustrating other examples of an indication of a sub-window illustrated in FIG. 4.

Specifically, it is assumed that an analog detector assigned with an address number of 99 is connected to the fire control panel FA and that the operator selects the terminal device control switch 31 labeled "99". Then, the display control unit 4 extracts the terminal device type KI and the status associated with the address number of 99 in the terminal database DB, and displays the terminal device type KI and the status in the sub-window 40. When the status of the analog detector is normal (ordinary), as illustrated in FIG. 5A, "Normal" indicating that the analog detector is normal (ordinary) is displayed in the sub-window 40. On the other hand, while the analog detector is sensing a fire, as illustrated in FIG. 5B, "Alarm" information indicating that a fire has occurred is displayed in the sub-window 40.

Figure 6:
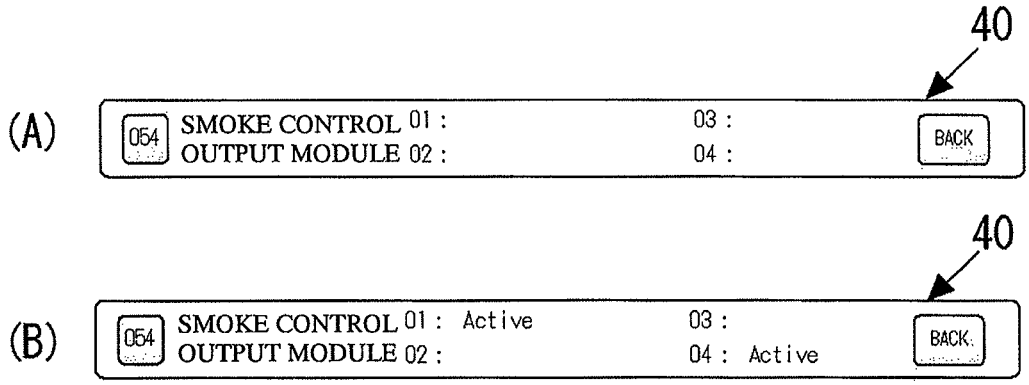
FIGS. 6A and 6B are schematic diagrams illustrating other examples of the indication of the sub-window illustrated in FIG. 4.

Further, it is assumed that a smoke control output module assigned with an address number of 54 is connected to the fire control panel FA and that the operator selects the terminal device control switch 31 labeled as "54". Then, as illustrated in FIGS. 6A and 6B, the statuses of four smoke control devices connected to the smoke control output module are displayed. For example, when each of the smoke control devices is in a normal (ordinary) status, nothing is displayed as illustrated in FIG. 6A. On the other hand, when each of the smoke control devices is active, as illustrated in FIG. 6B, a predetermined indication of the status is displayed next to the serial number of each of the smoke control devices.

Note that, a plurality of statuses is occasionally stored for one terminal device in the terminal database DB. In this case, the display control unit 4 displays the terminal device control switch 31 on the display/operation unit 2 in the mode corresponding to the status having the highest priority among the plurality of statuses. Note that, the priority is previously set in the display control unit 4 in descending order of, for example, red (Alarm), pink (Pre-Discharge, Discharge), orange (Supervisory), blue (Active), yellow (Trouble), and green (Bypass).

Specifically, in a case where the terminal device is a module, the statuses of the plurality of controlled devices connected to the module are stored in the terminal database DB as shown in FIG. 3. At this time, the display control unit 4 displays the terminal device control switch 31 indicating the module by coloring the terminal device control switch 31 in the color representing the highest priority among the controlled devices connected to the module. For example, when one of the four controlled devices connected to the module indicates an active state and another one thereof indicates an abnormal state, the terminal device control switch 31 corresponding to the module is displayed in blue.

In an upper part of the address map window 30 illustrated in FIG. 4, circuit information 32, a circuit change-over switch 33, and address change-over switches 34 and 35 are arranged. Displayed as the circuit information 32 is the circuit of the address map window 30 that is currently displayed. The circuit change-over switch 33 changes over the circuit of the address map window 30 that is displayed, among a plurality of circuits connected to the fire control panel FA. Here, when the circuit change-over switch 33 is selected, a plurality of circuit switches 51 are displayed in the sub-window 40 (see FIG. 7). When the operator selects any one of the circuit switches 51, the address map window 30 for the selected circuit is generated and displayed.

The address change-over switches 34 and 35 illustrated in FIG. 4 are used to designate an address area to be displayed on one screen, and when the address change-over switch 34 is selected, the terminal device control switches 31 corresponding to address numbers AD of 001 to 128 are displayed. On the other hand, when the address change-over switch 35 is selected, the terminal device control switches 31 corresponding to address numbers AD of 129 to 255 are displayed. Note that, FIG. 4 illustrates an exemplary case where two address change-over switches 34 and 35 are provided, but all the address numbers AD of the terminal devices connected to each of the circuits may be viewed by another method such as use of a scrollbar.

Next, an operation example of the fire control panel FA is described with reference to FIGS. 1 to 7.

In a normal state, a screen for displaying a predetermined number of occurred events (for example, five events) such as a fire in detail in time series is displayed in the display/operation unit 2 of the fire control panel FA. Specifically, when a fire has occurred as an example of the event, the circuit, the address number AD, the terminal device type KI, and the status of the terminal device that has issued a fire status are displayed on the display/operation unit 2.

When the operator performs an operation for displaying the address map window 30 through the display/operation unit 2, under control of the display control unit 4, the address map window 30 in which the terminal device control switches 31 are arranged in a matrix shape is displayed on the display/operation unit 2 as illustrated in FIG. 4. At this time, the display control unit 4 displays each of the terminal device control switches 31 in a colored state corresponding to the status stored in the terminal database DB stored in the storage unit 3.

When the operator selects any one of the plurality of terminal device control switches 31 arranged in a matrix shape, the detailed status of the terminal device to which the selected address number AD is assigned is displayed in the sub-window 40 as illustrated in FIGS. 5A and 5B and FIGS. 6A and 6B.

Figure 7:
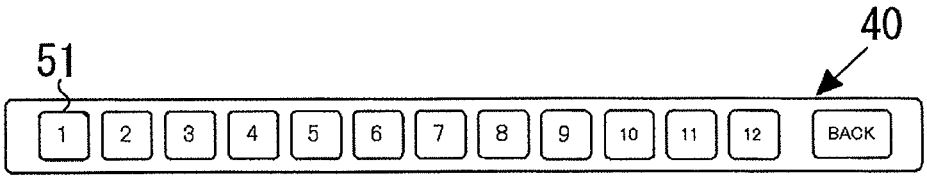
FIG. 7 is a schematic diagram illustrating another example of the indication of the sub-window illustrated in FIG. 4.

Further, when the operator wishes to confirm the statuses of the terminal devices of another circuit, the circuit change-over switch 33 is selected. Then, the circuit switches 51 are displayed in the sub-window 40 as illustrated in FIG. 7, and the operator selects the circuit switch 51 to which the number of the circuit to be confirmed is assigned. Then, the other circuit is displayed by the display control unit 4. With this configuration, it is possible to grasp the statuses of all the terminal devices of all the circuits that are connected to the fire control panel FA.

According to the above-mentioned embodiment, the address numbers AD of the terminal devices are displayed in a list, while status information is displayed in colors, to thereby allow the status information on a large number of terminal devices to be grasped at a glance through one screen, and hence it is possible to improve working efficiency. That is, in a case where a large number of various kinds of status information on various terminal devices are displayed as the character information, it is necessary to sort the statuses while understanding and judging characters. On the other hand, if the address map window 30 is used to display the statuses of the terminal devices in colors as described above, it is possible to quickly sort the statuses intuitively. Therefore, for example, in a case where wirings undergo disconnection and there is no response from the terminal devices connected after the disconnection, it is possible to easily extract the terminal device displayed in only the color corresponding to no response and to facilitate identification of a broken portion.

The embodiment of the present invention is not limited to the above-mentioned embodiment. For example, FIG. 1 illustrates the example of using a touch panel in which a display unit and an operation unit are provided integrally, but the display unit and the operation unit may be provided separately. For example, the display unit may be formed of a liquid crystal panel or the like, and the operation unit may be formed of a mouse, a mouse pad, a keyboard, or the like, thereby allowing the operator to select various switches by operating the operation unit while viewing the display of the display unit.

Further, the above-mentioned embodiment is exemplified by the case where the coloring is used as a display mode corresponding to each status, but each switch may be displayed in a shape that differs depending on the status, or a display method may be changed to blinking or the like.

Further, in the above-mentioned embodiment, the status of the terminal device is displayed in color in the terminal device control switch 31 also having a switch function for displaying the detail of the terminal device in the sub-window 40, but the switch function may be deleted, and only the status of the terminal device may be displayed.

What is claimed is:

1. A fire control panel, which is connected to a plurality of terminal devices via a signal line, comprising:

a storage unit for storing a terminal database in which addresses assigned to the plurality of terminal devices on a one-to-one basis and statuses of the plurality of terminal devices are stored in association with each other;

a display unit for displaying information relating to the plurality of terminal devices stored in the terminal database; and a display control unit for displaying a plurality of terminal device control symbols respectively labeled with the addresses of the plurality of terminal devices on the display unit in a state of being arranged in a matrix shape so as to be displayed in a list, and further displaying the plurality of terminal device control symbols on the display unit in different display modes corresponding to the statuses of the plurality of terminal devices stored in the terminal database.

2. A fire control panel according to claim 1, wherein:

the display control unit has priorities previously set for the statuses of the plurality of terminal devices; and the display control unit displays, when a plurality of statuses are stored for one of the plurality of terminal devices in the terminal database, a corresponding one of the plurality of terminal device control symbols in the display unit in a mode corresponding to a status having a highest priority among the plurality of statuses.

3. A fire control panel according to claim 2, wherein:

the plurality of terminal device control symbols comprise a plurality of terminal device control switches having a switch function; and the display control unit displays, when one of the plurality of terminal device control switches is selected, a type of one of the plurality of terminal devices associated with a corresponding one of the addresses assigned to the one of the plurality of terminal device control switches and a corresponding one of the statuses of the one of the plurality of terminal devices on the display unit.

* * * * *